United States Patent [19]

Sonesson

[11] Patent Number: 5,041,051

[45] Date of Patent: Aug. 20, 1991

[54] SPHEROID SHAPED TOY VEHICLE WITH INTERNAL RADIO CONTROLLED STEERING AND DRIVING MEANS

[76] Inventor: Harald V. Sonesson, Rudeboksvägen 28, S-222 55 Lund, Sweden

[21] Appl. No.: 482,760

[22] Filed: Feb. 21, 1990

[51] Int. Cl.[5] ..... A63H 29/00; A63H 17/00; A63B 71/00; A63G 25/00

[52] U.S. Cl. ..... 446/456; 446/437; 273/128 R; 280/207

[58] Field of Search ..... 446/456, 454, 457, 460, 446/437, 431; 273/58 G, 58 F, 65 R, 128 R; 180/10; 280/206, 207

[56] References Cited

U.S. PATENT DOCUMENTS

| | | | |
|---|---|---|---|
| 2,524,546 | 10/1950 | Sinclaire | 273/128 A |
| 2,832,426 | 4/1958 | Seargeant | 180/2.1 |
| 3,500,579 | 3/1970 | Bryer | 446/462 |
| 3,519,273 | 7/1970 | Viby | 273/128 R |
| 3,722,134 | 3/1973 | Merrill et al. | 446/462 |
| 3,746,117 | 7/1973 | Alred | 180/21 |
| 4,213,266 | 7/1980 | Hyland et al. | 273/58 F X |
| 4,386,787 | 6/1983 | Maplethorpe et al. | 280/206 |
| 4,438,588 | 3/1984 | Martin | 446/456 X |
| 4,471,567 | 9/1984 | Martin | 446/437 |
| 4,501,569 | 2/1985 | Clark, Jr. et al. | 446/460 X |
| 4,541,814 | 9/1985 | Martin | 446/456 |
| 4,568,306 | 2/1986 | Martin | 446/460 X |
| 4,601,675 | 7/1986 | Robinson | 446/460 X |
| 4,609,196 | 9/1986 | Bozinovic | 446/437 X |
| 4,726,800 | 2/1988 | Kobayashi | 446/548 |

FOREIGN PATENT DOCUMENTS

| | | | |
|---|---|---|---|
| 2539904 | 7/1984 | France | 446/454 |
| 1292441 | 10/1972 | United Kingdom | 446/456 |

*Primary Examiner*—Robert A. Hafer
*Assistant Examiner*—D. Neal Muir
*Attorney, Agent, or Firm*—Laurence R. Brown

[57] ABSTRACT

A radio-controlled rolling toy has a hollow shell containing a radio-controlled vehicle which may be caused to move sidewardly relative a shaft mounted coaxially with the outer surface of the shell. The vehicle may also be caused to perform a rotation relative the shell, the combination of said two movements enabling the shell to follow any type of tortous path on the ground.

4 Claims, 2 Drawing Sheets

SPHEROID SHAPED TOY VEHICLE WITH INTERNAL RADIO CONTROLLED STEERING AND DRIVING MEANS

Cross reference is made to my co-pending applications: Ser. No. 07/333,035, filed Apr. 4th, 1989 for A BALL WITH UNBALANCE MECHANISM and Ser. No. 07/390,773, filed Aug. 8th, 1989.

FIELD OF THE INVENTION

This invention relates to a radio controlled rolling toy for use as an amusement device.

BACKGROUND OF THE INVENTION

Various proposals for radio controlled rolling toys have been made making it possible to perform ball games of new types while ressembling classic ball games in which only human influence is used.

It is the object of the present invention to provide a radio controlled toy having the appearance and movements of a rolling foot ball (spheroid).

SUMMARY OF THE INVENTION

In order to achieve the above object, the invention provides a radio controlled rolling toy comprising a hollow shell having first a drum shaped outer surface and an inner space limited by a second rotation symmetrical surface coaxial with said drum shaped outer surface and two axially spaced plane surfaces extending perpendicular to the axis of symmetry of said first and second surfaces, said space containing a radio controllable vehicle having a chassis provided with steering means and driving means adapted to engage said second rotation symmetrical surface so as to cause relative rotation between said shell and said vehicle, said shell also carrying a shaft journalled rotatably around said axis of symmetry, means being provided for exerting a compression force between vehicle and said shaft.

DETAILED DESCRIPTION

Figure 1:
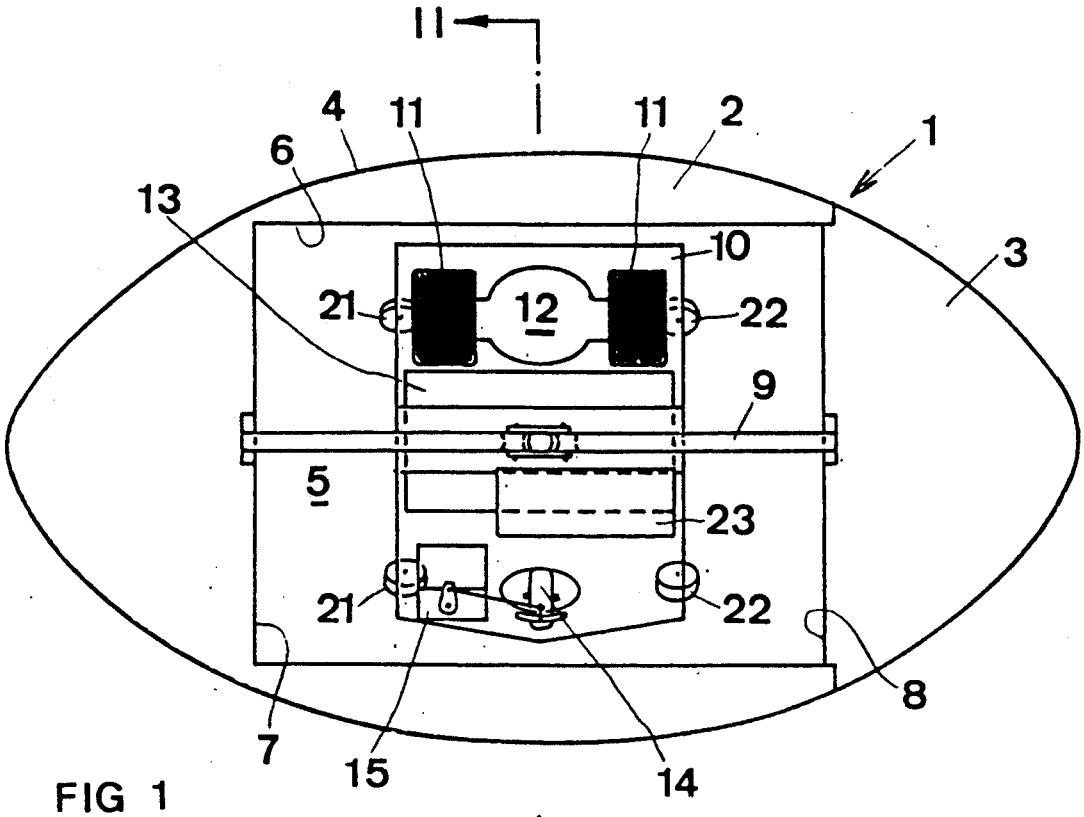
FIG. 1 is a longitudinal section through an embodiment of the toy according to the invention, said section taken along the lines I—I of FIG. 2.

The toy shown comprises a hollow shell 1 consisting of a body 2 and a cover 3. The shell has a first drum (spheroid) shaped outer surface 4 and the body 2 has an inner space 5 limited by a second rotation symmetrical surface 6—a cylindrical surface—and two axially spaced plane surfaces 7 and 8—the surface 8 being provided by the cover 3. The cylindrical surface 6 is coaxial with the outer surface 4 and with a shaft 9 journalled in the shell parts 2 and 3.

The space 5 contains a radio controllable vehicle having a chassis 10 provided with two driving wheels 11 adapted to engage the cylindrical surface 6. The wheels are connected to an electric motor 12 powered from a battery 13. The chassis is also provided with a steering wheel 14 engaging the surface 6. Said wheel 14 is controlled by a steering servo nechanism 15.

Figure 2:
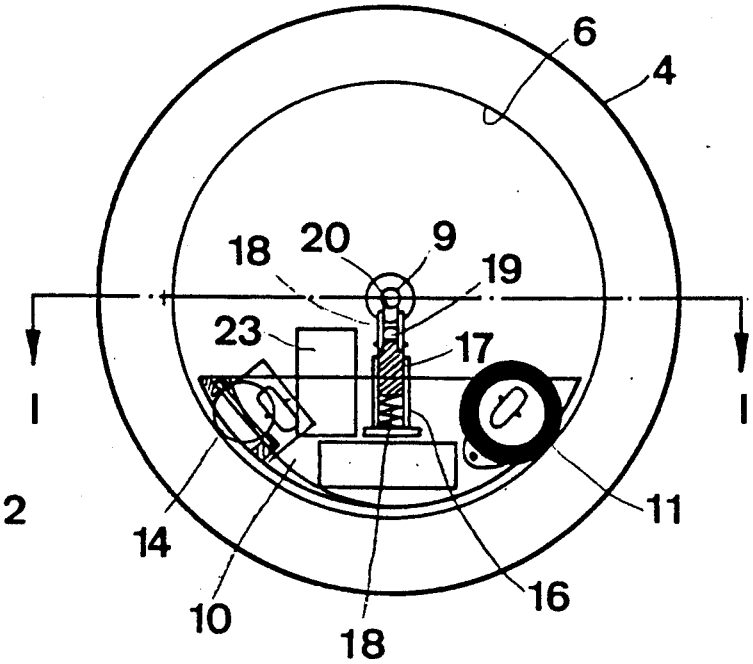
FIG. 2 is a cross section along the lines II—II of FIG. 1.
Figure 3:
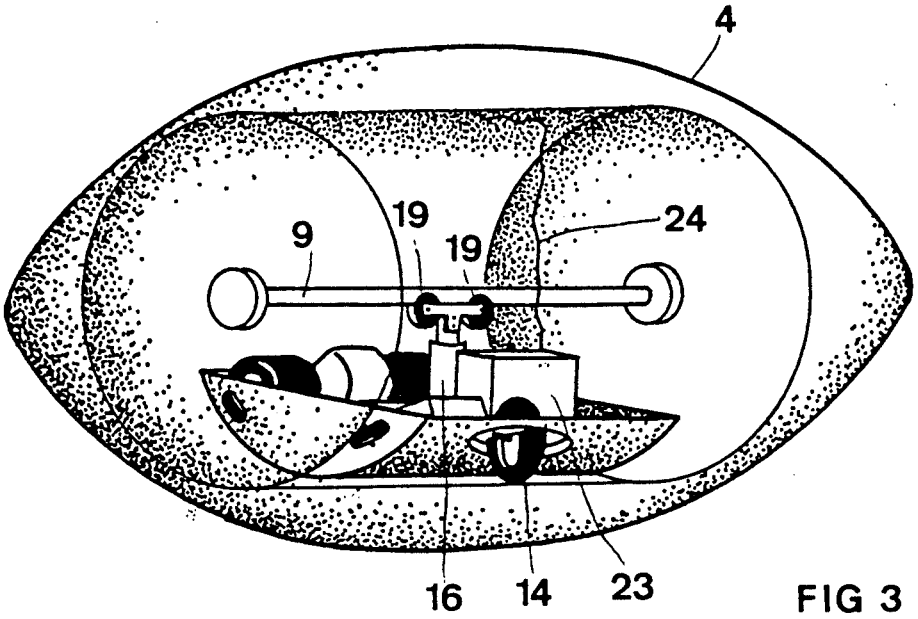
FIG. 3 is a perspective view of the toy shown in FIGS. 1-2.

As shown best in FIG. 2 the chassis 10 carries a tube 16 receiving a cylinder 17 slidably therein. A coiled compression spring 18 tends to move the cylinder 17 in the direction out of the tube 16. The cylinder 17 carries a bracket 18 provided with two wheels 19 having recessed peripheries 20 adapted to engage the shaft 9 and thus limit the outward travel of the cylinder 17 from the tube 16 influenced by the spring 18. Finally the chassis 10 carries two pairs of wheels 21 and 22—said pairs of wheels being located at the extreme axial ends of the chassis 10 and thus adapted to reduce friction in case of axial contact between the vehicle in the space 5 and the surfaces 7 and 8. A control unit 23 is receiving signals via an antenna 24—only shown in FIG. 3. Said signals are controlling the power to the driving wheels 11 and to the steering servo mechanism 15 in conventional manner.

The device described above and shown in the drawings will operate as follows:

Upon activation of the driving wheels 11 the chassi 10 will start climbing the cylindrical surface 6 of the space 5. However, due to the weight of the chassis 10 and its attachments the shell 1 will start rolling on the ground. Upon activation of the steering wheel 14 the chassis 10 will be displaced sidewardly towards one or the other of the surfaces 7, 8. Again the shell will roll upon the ground until the center of gravity of the vehicle in the space 5 has been located just above the point of contact between the shell 1 and the ground. However, this will cause the shell 1 to tilt and—if the driving wheels 11 are activated—to deviate from a straight forward path. The pairs of wheels 21 and 22 ensure that the chassi 10 may continue rolling inside the space 5 also in case the chassi 10 is in its extreme end positions. The spring 18 ensures that a force is transmitted between the cylindrical surface 6 and the wheels 11. A corresponding force is transmitted between the wheels 19 and the shaft 9, but without causing substantial resistance against sideward movements of the chassis 10 or against relative rotation between the surface 6 and the chassis 10.

It will be understood that the toy described above and shown in the drawings may be caused to follow a most intricate path solely by activating the driving wheels 11 and the steering wheel 14 via conventional remote-controlled means.

Figure 4:
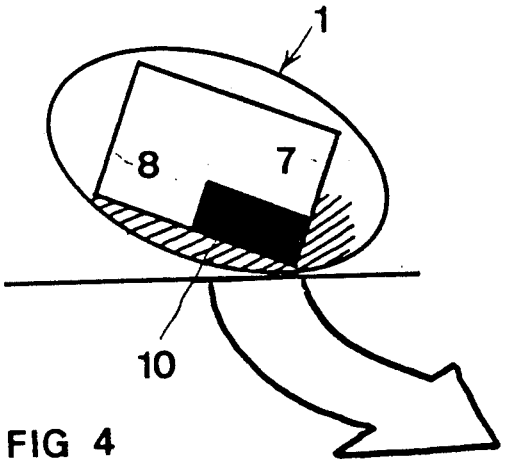
FIGS. 4 and 5 are illustrations of the function of the toy.
Figure 5:
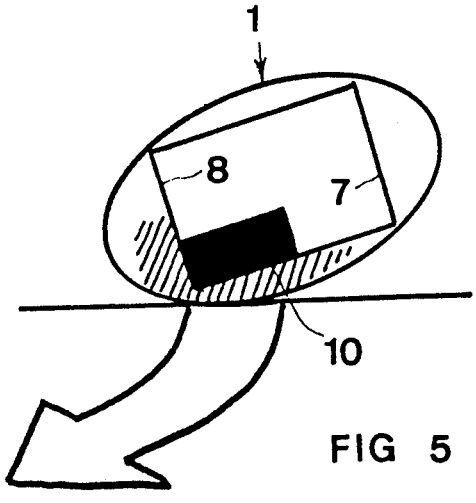

This has been illustrated in FIGS. 4 and 5.

In case the chassis 10 is moved towards the end surface 7 of the space 5—as shown in FIG. 4—the shell 1 will tilt and contact the ground along decreasing drum diameters. Activated driving wheels 11 will now cause a turning of the path of the toy as indicated by an arrow.

Similarly, in case the chassis 10 is caused to travel in the direction towards the end surface 8 the toy will perform a path as indicated by an arrow in FIG. 5.

I claim:

1. a radio controlled rolling toy comprising in combination, a shell of substantially spheroidal shape defining an internal coaxial space of substantially cylindrical shape, a shaft extending coaxially through said space, radio controllable drive means for engaging cylindrically the internal space to roll the shell about the shaft, and steering means including wheels for axially moving said drive means over a predetermined range along said shaft including elastic biasing means exerting a force between the drive means and the shaft.

2. a radio controlled rolling toy, comprising in combination, a hollow shell having a first substantially spheroid shaped outer surface with a first rotation symmetrical surface dispersed about an axis of symmetry and an inner member defining a space limited by a second rotation symmetrical surface coaxial with said spheroid shaped outer surface and two axially spaced plane surfaces extending perpendicular to the axis of symmetry of said first and second surfaces, said space containing a radio controllable vehicle with wheels for engaging said plane surfaces at the ends of a range of axial travel of said vehicle within said inner space and having a chassis provided with steering means and driving means adapted to engage said second rotation symmetrical surface so as to cause relative rotation between said shell and said vehicle, said shell also carrying a shaft positioned on said axis of symmetry along which said vehicle moves, and elastic biasing means being provided for exerting a compression force between said vehicle and said shaft.

3. A toy as claimed in claim 2, characterized in that said elastic biasing means comprises two telescopically displaceable elements, with a compression force spring located between said elements and means for positioning said wheels in engagement with said shaft mounted on one of said elements.

4. A toy as claimed in claim 1 wherein said steering means comprises means to move said chassis axially on said shaft.

* * * * *